US006065434A

United States Patent [19]

Schmidt

[11] Patent Number: 6,065,434

[45] Date of Patent: May 23, 2000

[54] TILTING OR DRAG LEVER WITH A VALVE CLEARANCE EQUALIZING ELEMENT

[75] Inventor: Dieter Schmidt, Nurnberg, Germany

[73] Assignee: Ina Walzlager Schaeffler oHG, Germany

[21] Appl. No.: 09/142,516

[22] PCT Filed: Dec. 17, 1996

[86] PCT No.: PCT/EP96/05665

§ 371 Date: Sep. 4, 1998

§ 102(e) Date: Sep. 4, 1998

[87] PCT Pub. No.: WO97/35097

PCT Pub. Date: Sep. 25, 1997

[30] Foreign Application Priority Data

Mar. 15, 1996 [DE] Germany ..... 196 10 107

[51] Int. Cl.[7] ..... F01L 1/20; F01L 1/18

[52] U.S. Cl. ..... 123/90.46; 123/90.43; 123/90.55

[58] Field of Search ..... 123/90.43, 90.46, 123/90.55

[56] References Cited

U.S. PATENT DOCUMENTS

| | | | |
|---|---|---|---|
| 4,402,285 | 9/1983 | Arai et al. | 123/90.58 |
| 4,554,895 | 11/1985 | Ono | 123/90.55 |
| 4,570,582 | 2/1986 | Speil | 123/90.46 |
| 4,644,914 | 2/1987 | Morita et al. | 123/90.55 |
| 4,729,350 | 3/1988 | Speil | 123/90.55 |
| 4,788,947 | 12/1988 | Edelmayer | 123/90.55 |
| 4,800,851 | 1/1989 | Hertrich et al. | 123/90.46 |
| 5,353,756 | 10/1994 | Murata et al. | 123/90.16 |
| 5,881,691 | 3/1999 | Schmidt et al. | 123/90.46 |

FOREIGN PATENT DOCUMENTS

| | | | |
|---|---|---|---|
| 0524664 | 1/1993 | European Pat. Off. . | |
| 2652154 | 5/1978 | Germany . | |
| 3408557 | 10/1984 | Germany . | |
| 3526292 | 3/1986 | Germany . | |
| 3706006 | 9/1988 | Germany . | |
| 19502497 | 7/1996 | Germany . | |
| 59-208111 | 11/1984 | Japan | 123/90.55 |

*Primary Examiner*—Tony M. Argenbright
*Assistant Examiner*—Brian J. Hairston
*Attorney, Agent, or Firm*—Bierman, Muserlian and Lucas

[57] ABSTRACT

A rocker arm or a finger lever (1) receives a valve clearance compensation element (4) in a reception bore (3). A cap (15) inserted into this reception bore (3) supports one end of an inner piston (7) of the valve clearance compensation element (4). This cap, through which on the one hand, the pressure medium is fed into an oil reservoir (8) and which, on the other hand, vents this oil reservoir (8) is fixed by an extension (17) in a complementary opening (18) of the rocker arm or the finger lever.

9 Claims, 1 Drawing Sheet

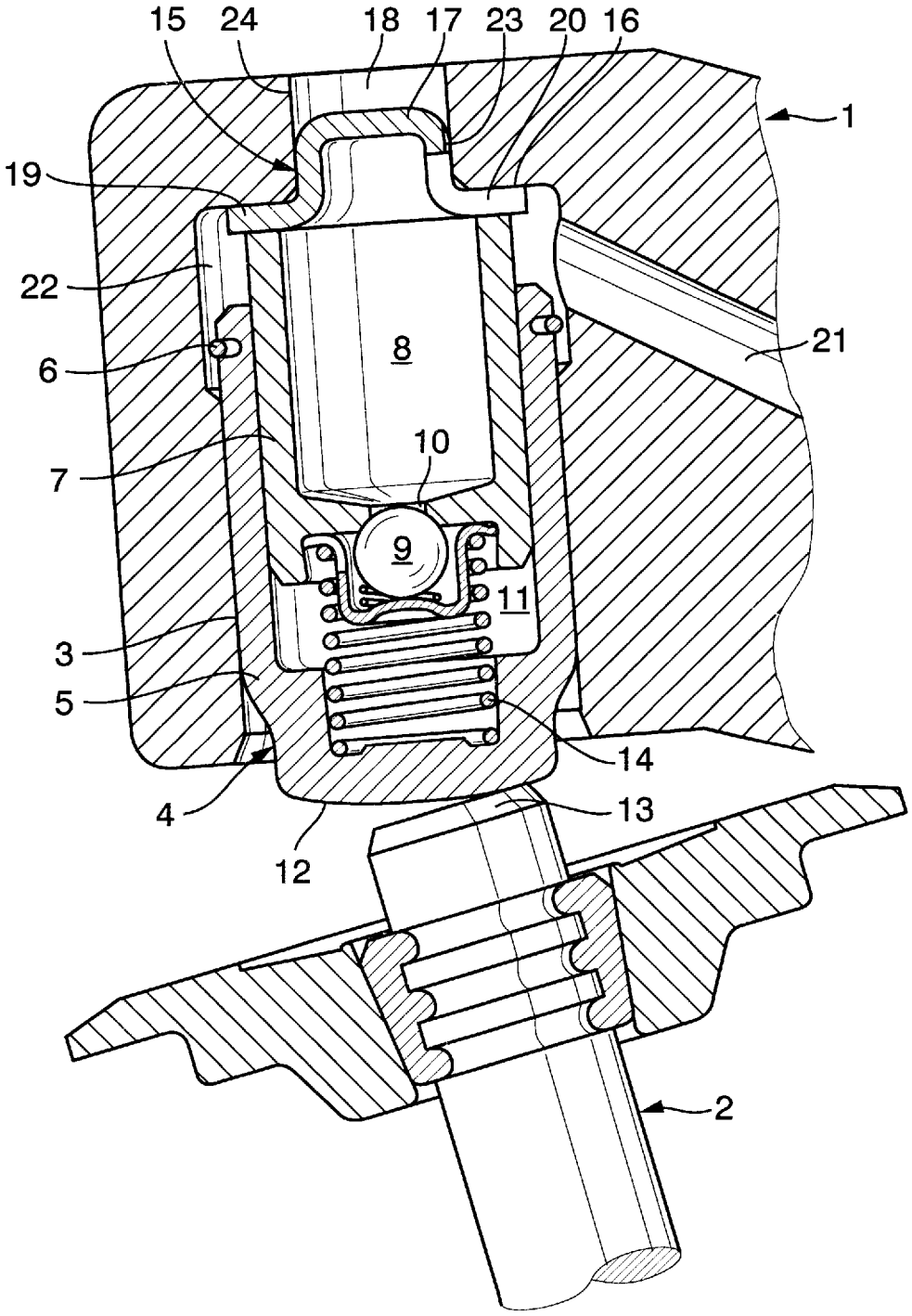
15
24
18
17
23
20
16
1
19
22
21
6
8
7
10
9
11
3
5
14
4
13
12
2

TILTING OR DRAG LEVER WITH A VALVE CLEARANCE EQUALIZING ELEMENT

FIELD OF THE INVENTION

The invention concerns a rocker arm or a finger lever comprising on an end thereof adjacent a valve stem end of a gas exchange valve, a reception bore in which is arranged a valve clearance compensation element, a hollow inner piston of the valve clearance compensation element being supported on a cap which delimits the reception bore at one end in axial direction, said inner piston, together with the cap, surrounding an oil reservoir which is connected to an oil supply bore through at least one aperture provided in the substantially disc-shaped cap.

BACKGROUND OF THE INVENTION

A rocker arm of the pre-cited type is known from DE-A 26 52 154. In this case, the cap is configured as a flat disc which is secured in axial direction in the reception bore by a circlip. The outer diameter of the disc and the diameter of the reception bore are matched to each other so that a narrow annular gap is formed therebetween through which air can escape to the exterior. Further, the hollow inner piston of the valve clearance compensation element is provided on its end with slots, or radially extending grooves are provided in the end face of the disc facing the inner piston. The two last-mentioned means are intended to permit the pressure medium which flows from the oil supply bore at first into an annular space to flow further into the oil reservoir. A drawback of this arrangement is that the cap can become displaced radially to the extent that a vent gap is formed only in a certain edge region. Depending on the position of this gap and the position the rocker arm or the finger lever takes during the standstill of the internal combustion piston engine, so much pressure medium can escape from the valve clearance compensation element through this vent gap that the operation of the valve clearance compensation element is not guaranteed at first on a re-starting of the internal combustion piston engine. In addition, the oil serving as the pressure medium can flow out through the guide gap between the valve clearance compensation element and the peripheral surface of the reception bore. Moreover, the fact that grooves have to be made in the disc, or slots stamped into the inner piston, increases the costs of manufacture.

SUMMARY OF THE INVENTION

The object of the invention is therefore to eliminate the mentioned drawbacks and create, in a simple manner, a cap which conveys the pressure medium into the oil reservoir and serves simultaneously to vent the same.

The invention achieves this object by the fact that, on the end of the cap turned away from the oil reservoir, there is arranged at least one extension which projects in axial direction and engages into a complementary opening of the rocker arm or the finger lever and, together with a wall section of the opening forms a vent orifice. This means that the cap is exactly guided in the opening so that a vent function and a conveyance of pressure medium into the oil reservoir can both be assured by simple means.

The extension can be configured as a concentric cylindrical formation while the opening is a bore extending concentrically to the reception bore. Such a formation can be made on the disc in a simple manner by chipless forming. The bore of the rocker arm or the finger lever is then provided with a stepped configuration which can be made by simple means, for example in a cast rocker arm or finger lever. It is, however, also possible to make the rocker arm or the finger lever out of sheet metal in which case, the reception bore can be consituted by a cylindrical sheet metal element. In addition, with the help of this formation, the volume of the oil reservoir can be enlarged without a modification of the overall height of the valve clearance compensation element. Consequently, if the volume of the oil reservoir is left unchanged, the overall height can be reduced.

According to a further development of the invention, the cap can be secured against rotation in the rocker arm or the finger lever by press-fitting the formation into the bore. Such a prevention of rotation is expedient when the vent orifice has to take a pre-defined position which should not change during the operation of the internal combustion piston engine. In this way, the valve clearance compensation element can be made leak-tight.

Moreover, it is also possible to make the aperture as a radial cut-out in the disc-shaped portion of the cap. This simple-to-make cut-out guarantees a transfer of oil between the edge of the inner piston and a step formed on the reception bore. In this way, a reliable oil transfer into the oil reservoir is assured by simple means.

According to a preferred embodiment of the invention, the vent orifice is situated within the circumferential sector of the aperture and the vent orifice is formed by a flattening, bead or stamping on a peripheral surface of the formation and by an inner peripheral surface of the bore. In this way, in conjunction with an eventually existing anti-rotation feature of the cap, it is possible to effect a controlled venting of the valve clearance compensation element and a likewise controlled filling of the oil reservoir. A preferred position in which to fix the cap against rotation is one in which the aperture and the vent orifice are situated opposite a mouth of the oil supply bore.

A reduction of weight by a reduction of the radial dimension of the cap can likewise be achieved in conjunction with the extension which fixes it in the reception bore, either by making the cap with a smaller diameter than the reception bore, or by making a diameter of the cap to correspond substantially to an outer diameter of the pressure piston.

An example of embodiment of the invention is represented in the drawing and will be described more closely in the following.

BRIEF DESCRIPTION OF THE DRAWING

The sole FIGURE shows a longitudinal section through an end portion of a rocker arm or a finger lever facing a valve stem end of a gas exchange valve.

DETAILED DESCRIPTION OF THE DRAWING

In the sole FIGURE, a rocker arm or a finger lever which cooperates with a gas exchange valve 2 of an internal combustion piston engine, not shown, is identified at 1. Likewise not shown is a camshaft which actuates the pivotable rocker arm or finger lever 1 through a cam. In the case of a rocker arm configuration, an axis of pivot is at a central point and in the case of a finger lever configuration, an axis of pivot is situated at an end of the finger lever opposite the end portion shown in the FIGURE. The rocker arm or finger lever comprises a reception bore 3 which receives a hydraulic valve clearance compensation element 4. This hydraulic valve clearance compensation element 4 comprises a pressure piston 5 which is guided directly in the reception bore 3 and whose maximum displacement is limited by a snap ring 6. In its interior, the pressure piston 5, which has a hollow configuration, receives an inner piston 7 which likewise has a hollow configuration and whose hollow inner space serves as an oil reservoir 8. A valve bore 10 closed by a non-return valve 9 leads from this oil reservoir 8 into a high pressure chamber 11 defined by ends of the pressure piston 5 and the inner piston 7. The pressure piston 5 which bears by a spherical end face 12 against a valve stem end 13 of the gas exchange valve 2 is supported through a compression spring 14 on the inner piston 7.

In the reception bore 3 there is further disposed a cap 15 which is supported on a bottom 16 of the reception bore 3, against which cap 15, in turn, the inner piston 7 bears. In this way, the cap 15 and the inner piston 7 define the oil reservoir 8. The cap 15 is generally configured in the form of a disc but comprises an extension 17 which is oriented away from the oil reservoir 8 and projects in axial direction. This extension 17 which is configured as a chiplessly made formation is hat-shaped and projects into a bore 18 which is concentric to the reception bore. The diameter of the bore 18 is considerably smaller than that of the reception bore 3 so that a generally step-like bore configuration including the already mentioned bottom 16 is obtained. The cap 15 bears against this bottom 16 through a disc-shaped portion 19.

This disc-shaped portion 19 and a part of the extension 17 comprise a radial aperture through which pressure medium from an oil supply bore 21 and an annular space 22 connected thereto can flow into the central oil reservoir 8. Further, the radial aperture 20 made as a cut-out merges into a vent orifice made as a flattening 23 of the extension 17. This vent orifice is delimited on the other side by a peripheral surface 24 of the bore 18.

The FIGURE makes it clear that due to the special shape of the cap 15, a particularly compact overall arrangement is possible. As compared to the prior art cap which comprises radial grooves, the overall dimensions in the end region i.e. at the support of the inner piston can be reduced by about 2 to 3 mm with a simultaneous enlargement of the oil reservoir 8. Further, it is possible to press-fit the cap 15 of the invention into the bore 18 by its extension 17 so that the cap 15 is fixed in a defined position in which the valve clearance compensation element 4 cannot leak in the respective position of the rocker arm or the finger lever at any given time. Altogether, the arrangement of the invention is manufacturable with economic means.

LIST OF REFERENCE NUMBERS

1 Rocker arm or finger lever
2 Gas exchange valve
3 Reception bore
4 Hydr. valve clearance compensation element
5 Pressure piston
6 Snap ring
7 Inner piston
8 Oil reservoir
9 Non-return valve
10 Valve bore
11 High pressure chamber
12 Spherical end face of 5
13 Valve stem end
14 Compression spring
15 Cap
16 Bottom of 3
17 Extension of 15
18 Bore
19 Disc-shaped portion of 15
20 Radial apertures in 19
21 Oil supply bore
22 Annular space
23 Flattening
24 Peripheral surface

I claim:

1. A rocker arm or a finger lever (1) comprising on an end thereof adjacent a valve stem end (13) of a gas exchange valve (2), a reception bore (3) in which is arranged a valve clearance compensation element (4), a hollow inner piston (7) of the valve clearance compensation element (4) being supported on a cap (15) which delimits the reception bore (3) at one end in an axial direction, said inner piston (7), together with the cap (15), surrounding an oil reservoir (8) which is connected to an oil supply bore (21) through at least one aperture (20) provided in the substantially disc-shaped cap (15), and the cap (15) forming a vent orifice (23), characterized in that, on the end of the cap (15) turned away from the oil reservoir (8), there is arranged at least one extension (17) which projects in an axial direction and engages into a complementary opening (18) of the rocker arm or the finger lever (1) and, together with a wall section (24) of the opening (18) forms a vent orifice (23).

2. A rocker arm or a finger lever (1) according to claim 1, characterized in that the extension (17) is configured as a concentric cylindrical formation and the opening is configured as a bore (18) extending concentric to the reception bore.

3. A rocker arm or a finger lever according to claim 2, characterized in that the cap (15) is secured against rotation in the rocker arm or the finger lever (1) by press-fitting the extension (17) into the bore.

4. A rocker arm or a finger lever according to claim 2, characterized in that the aperture is made as a radial cut-out (20) in the disc-shaped portion (19) of the cap (15).

5. A rocker arm or a finger lever according to claim 4, characterized in that the vent orifice is formed by a flattening (23), bead or stamping on a peripheral surface of the formation and by a peripheral surface (24) of the bore (18).

6. A rocker arm or a finger lever according to claim 4, characterized in that the vent orifice is situated within the circumferential sector of the aperture (20).

7. A rocker arm or a finger lever according to claim 5, characterized in that, with help of the extension (17) which engages into the bore (18), the cap (15) is secured against rotation in a position in which the aperture (20) and the vent orifice (23) are situated opposite a mouth of the oil supply bore (21).

8. A rocker arm or a finger lever according to claim 1, characterized in that the cap (15) has a smaller diameter than the reception bore (3).

9. A rocker arm or a finger lever according to claim 1, characterized in that a diameter of the cap (15) corresponds substantially to an outer diameter of the inner piston (7).

* * * * *